US010594080B2

(12) United States Patent
Sugiki et al.

(10) Patent No.: US 10,594,080 B2
(45) Date of Patent: Mar. 17, 2020

(54) MOVABLE CONNECTOR

(71) Applicant: IRISO ELECTRONICS CO., LTD., Yokohama-shi, Kanagawa (JP)

(72) Inventors: Toshiaki Sugiki, Yokohama (JP); Hiroaki Kobayashi, Yokohama (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/190,376

(22) Filed: Nov. 14, 2018

(65) Prior Publication Data

US 2019/0148884 A1 May 16, 2019

(30) Foreign Application Priority Data

Nov. 16, 2017 (JP) ..... 2017-220675

(51) Int. Cl.
*H01R 13/631* (2006.01)
*H01R 13/502* (2006.01)
(Continued)

(52) U.S. Cl.
CPC ..... *H01R 13/6315* (2013.01); *H01R 12/91* (2013.01); *H01R 13/05* (2013.01);
(Continued)

(58) Field of Classification Search
USPC ..... 439/247
See application file for complete search history.

(56) References Cited

U.S. PATENT DOCUMENTS 5,306,169 A * 4/1994 Fukushima ..... H01R 12/712 439/248
6,939,154 B2 * 9/2005 Horikoshi ..... G11B 33/08 439/247
(Continued)

FOREIGN PATENT DOCUMENTS

EP 1 986 285 A1 10/2008
JP 2561222 Y2 1/1998
(Continued)

OTHER PUBLICATIONS

Office Action dated Aug. 21, 2018, by the Japanese Patent Office for Application No. 2017-220675.
(Continued)

*Primary Examiner* — Alexander Gilman
(74) *Attorney, Agent, or Firm* — Buchanan, Ingersoll & Rooney PC

(57) ABSTRACT

A movable connector is provided which includes a terminal formed of a single metal piece, the terminal enabling pliability in a movable portion and appropriate contact pressure in a contact portion to be obtained in a compatible way. The terminal of the movable connector includes a plate-thickness-direction conversion portion that interconnects a movable piece and a contact piece, and that reverses a plate thickness direction and a plate width direction of the terminal between the movable piece and the contact piece, and a front elastic arm and a rear elastic arm biasing respectively a front contact point and a rear contact point into pressure contact with the connection target in a direction crossing the plate thickness direction of the contact piece.

6 Claims, 9 Drawing Sheets

(51) Int. Cl.

| | |
|---|---|
| ***H01R 13/05*** | (2006.01) |
| ***H01R 12/91*** | (2011.01) |
| *H01R 12/71* | (2011.01) |
| *H01R 13/26* | (2006.01) |

(52) U.S. Cl.
CPC ..... *H01R 13/502* (2013.01); *H01R 12/716* (2013.01); *H01R 13/26* (2013.01)

(56) References Cited

U.S. PATENT DOCUMENTS 7,186,126 B2 * 3/2007 Umehara ..... H01R 13/33 439/247
7,517,232 B2 * 4/2009 Yuan ..... H01R 13/2442 439/79
7,922,539 B2 * 4/2011 Kubo ..... H01R 13/6315 439/247
8,202,126 B2 * 6/2012 Lim ..... H01R 13/6581 439/607.31
8,241,073 B2 * 8/2012 Hemmi ..... H01R 13/41 439/752
8,702,454 B2 * 4/2014 Hamada ..... H01R 13/04 439/733.1
8,814,612 B2 * 8/2014 Onuma ..... B21J 5/12 439/877
2010/0297893 A1 * 11/2010 Masuda ..... H01R 12/716 439/733.1
2016/0294089 A1 * 10/2016 Kobayashi ..... H01R 13/187

FOREIGN PATENT DOCUMENTS

| | | | |
|---|---|---|---|
| JP | H11-144823 | A | 5/1999 |
| JP | 2002-025697 | A | 1/2002 |
| JP | 2010272320 | A | 12/2010 |
| JP | 2016181495 | A | 10/2016 |

OTHER PUBLICATIONS

The extended European Search Report dated Mar. 21, 2019, by the European Patent Office in corresponding European Patent Application No. 18205583.0-1201. (8 pages).

* cited by examiner

MOVABLE CONNECTOR

BACKGROUND OF THE INVENTION

1. Field of the Invention

The present invention relates to an electrical connector having a floating function, i.e., a movable connector.

2. Description of the Related Art

A movable connector having a floating function is known as a connector for establishing conductive connection to a connection target. The movable connector includes, for example, a fixed housing mounted to a substrate, a movable housing having a fitting chamber into which the connection target is inserted, and a terminal including a movable portion constituted by a spring piece that has one end fixed to the fixed housing and the other end fixed to the movable housing, and that movably supports the movable housing between the one end and the other end (see, e.g., Japanese Unexamined Patent Application Publication No. 2010-272320, FIGS. 7 and 8).

In the above movable connector, the movable housing can be moved relative to the fixed housing with elastic deformation of the movable portion constituted by the spring piece. Therefore, the above movable connector can develop functions of absorbing deviation of an insertion position when the connection target is inserted into the fitting chamber of the movable housing, and of isolating or attenuating transmission of external vibration between the connection target and the substrate to which the movable connector is mounted. The applicant of this application has proposed a movable connector including a movable portion that has the above-described floating function, and that can absorb vibration acting on the connection target in a direction in which the movable portion is inserted into and withdrawn from the fitting chamber (see, e.g., Japanese Unexamined Patent Application Publication No. 2016-181495, FIGS. 24 and 25).

In the above-described prior-art movable connector, the terminal is formed of a single metal piece. Accordingly, when a metal plate having a thin thickness is used as a terminal material to form the movable portion constituted by the spring piece that is easy to elastically deform and that has high vibration absorptivity, it is difficult to obtain appropriate contact pressure at a contact point where the movable portion contacts the connection target for conductive connection. If the contact pressure at the contact point is insufficient, the contact point is caused to slightly slide relative to the connection target when the movable connector receives external vibration. This may raise a problem that plating films on the contact point and a contact surface of the connection target are peeled off, and good conductive connection can no longer be maintained.

SUMMARY OF THE INVENTION

The present invention has been made in consideration of the above-described background in the related art. An object of the present invention is to provide a movable connector including a terminal which is formed of a single metal piece, but which enables pliability in a movable portion and appropriate contact pressure in a contact portion to be obtained in a compatible way.

To achieve the above object, the present invention has the following features.

The present invention provides a movable connector including a first housing, a second housing into which a connection target is to be inserted, and a terminal including a movable piece that supports the second housing in a displaceable way relative to the first housing, and a contact piece having a contact point that is brought into contact with the connection target for conductive connection, wherein the terminal includes a plate-thickness-direction conversion portion that interconnects the movable piece and the contact piece, and that reverses a plate thickness direction and a plate width direction of the terminal between the movable piece and the contact piece, and an elastic arm biasing the contact point into pressure contact with the connection target in a direction crossing the plate thickness direction of the contact piece.

According to the above-described present invention, since the terminal includes the plate-thickness-direction conversion portion, the influence of a plate thickness of the movable piece can be avoided from spreading to the contact piece in spite of the movable piece and the contact piece being in the integral form. In other words, the movable piece being relatively thin can be formed by using a material having a smaller plate thickness with intent to, for example, increase flexibility of the movable piece. Furthermore, according to the present invention, because of including the elastic arm that is elastically deformed in a direction crossing the plate thickness direction of the contact piece when the connection target is inserted into the movable connector, contact pressure at the contact point against the connection target is less apt to lower even when the terminal is formed to be relatively thin by using a metal plate material having a smaller plate thickness. Thus, the movable connector can be provided in which vibration is more easily absorbed and stress is distributed in the movable piece, whereby durability is improved, and in which slight sliding between the contact point and the connection target is less apt to occur in the contact piece.

The contact point may be formed in a plate-thickness defining surface that extends, at an outer edge of the contact piece in the plate width direction, in a direction crossing the plate width direction of the contact piece.

According to the above-described present invention, since the contact point is formed in the plate-thickness defining surface, a contact area between the contact point and the connection target is smaller than that in the case of providing the contact point in, for example, a surface (rolled surface) of the contact piece, and the contact pressure generated by elastic deformation of the elastic arm acts to concentrate on the plate-thickness defining surface having the smaller contact area. It is hence possible to strengthen force for holding the contact piece on the connection target, and to make contact sliding less apt occur.

The contact piece may include a contact-piece base portion joined to the plate-thickness-direction conversion portion, the second housing may include a terminal receiving portion that has a bent groove-like shape, and that receives the plate-thickness-direction conversion portion and the contact-piece base portion, and the contact-piece base portion may include a press-fitting projection that is projected from a plate surface of the contact-piece base portion in the plate thickness direction, and that is press-fitted and fixed to the terminal receiving portion.

According to the above-described present invention, since the contact-piece base portion is fixed with the press-fitting projection being press-fitted to the terminal receiving portion, the contact-piece base portion can be firmly fixed to the second housing, and the contact piece can be stably brought into pressure contact with the connection target. The plate-thickness-direction conversion portion is a bent portion, and a bent angle of the plate-thickness-direction conversion portion is not agreed with that of the terminal receiving portion in some cases. Even in those cases, because of the terminal receiving portion having the bent groove-like shape, when the plate-thickness-direction conversion portion and the contact-piece base portion are inserted, the press-fitting projection abuts against a wall surface of the terminal receiving portion, thus causing the plate-thickness-direction conversion portion to deform such that an inclination of the contact piece relative to the movable piece is modified following the shape of the terminal receiving portion. As a result, the contact-piece base portion can be corrected to an appropriate posture.

The press-fitting projection may have a shape projecting from the plate surface of the contact-piece base portion in the plate thickness direction on internal angle side relative to the contact-piece base portion and the plate-thickness-direction conversion portion.

According to the above-described present invention, since the press-fitting projection is brought into pressure contact on the internal angle side relative to the contact-piece base portion and the plate-thickness-direction conversion portion, an internal angle between the plate-thickness-direction conversion portion and the contact-piece base portion, both tending to deform toward the side making the internal angle smaller, can be widened to correct the contact piece into an appropriate posture. As a result, a contact state between the connection target and the contact point can be further stabilized.

The movable piece may include a movable portion, and a second-housing-side base portion, and the second-housing-side base portion may be arranged between the plate-thickness-direction conversion portion and the movable portion, and may include a fixing portion for fixing the movable piece to the second housing.

According to the above-described present invention, since the fixing portion for fixing the movable piece to the second housing is formed between the plate-thickness-direction conversion portion and the movable portion, stress attributable to displacement or deformation generated in one of the plate-thickness-direction conversion portion and the movable portion can be prevented from being transmitted to the other by the presence of the fixing portion that is positioned between the above-mentioned two portions and serves as a fixing point to the second housing.

The second housing may include a fitting connection chamber into which the connection target is inserted along a plane direction of a mounting surface of a substrate to which the first housing is mounted, and the movable piece may have a vertically-vibrating wave shape including a plurality of vertical piece portions each extending in a direction crossing an insertion direction of the connection target into the fitting connection chamber, and a bent portion interconnecting ends of the vertical piece portions adjacent to each other.

According to the above-described present invention, in the movable connector of the so-called right-angle type that a fitting surface is perpendicular to the mounting surface when mounted, the movable piece includes the vertical piece portions each extending in the direction crossing the insertion direction of the connection target into the fitting connection chamber. According to the above-described present invention, therefore, in comparison with a movable connector having a horizontally-vibrating wave shape including a plurality of horizontal piece portions each of which extends in the insertion direction of the connection target into the fitting connection chamber, a longer spring length of the movable piece can be ensured, the second housing can be more pliably supported, and durability as a spring can be improved. Moreover, according to the above-described present invention, a distance through which the second housing is movable relative to the first housing particularly in the insertion direction of the connection target can be increased in comparison with the movable connector having the horizontally-vibrating wave shape. Therefore, flexibility is increased in the movable piece while reduction of the contact pressure at the contact point against the connection target is prevented by the presence of the elastic arm and the plate-thickness-direction conversion portion. Thus, the movable connector can be provided in which vibration is more easily absorbed and slight sliding between the contact point and the connection target is less apt to occur.

According to the movable connector of the present invention, since the terminal includes the plate-thickness-direction conversion portion, the contact piece can develop appropriate contact pressure even when the movable piece is formed to be pliable by forming the entire terminal using a metal plate having a smaller plate thickness. It is hence possible to provide the movable connector in which good floating function and stable contact reliability can be both obtained in a compatible way.

DESCRIPTION OF THE PREFERRED EMBODIMENTS

An embodiment of a "movable connector" according to the present invention will be described below with reference to the drawings. A movable connector 1 described in the following embodiment represent an example in which the movable connector 1 is mounted to a substrate P and is applied to a socket connector for connecting a plurality of terminals of a plug connector, i.e., a "connection target" in Claims, to a circuit on the substrate P for conductive connection.

Figure 1:
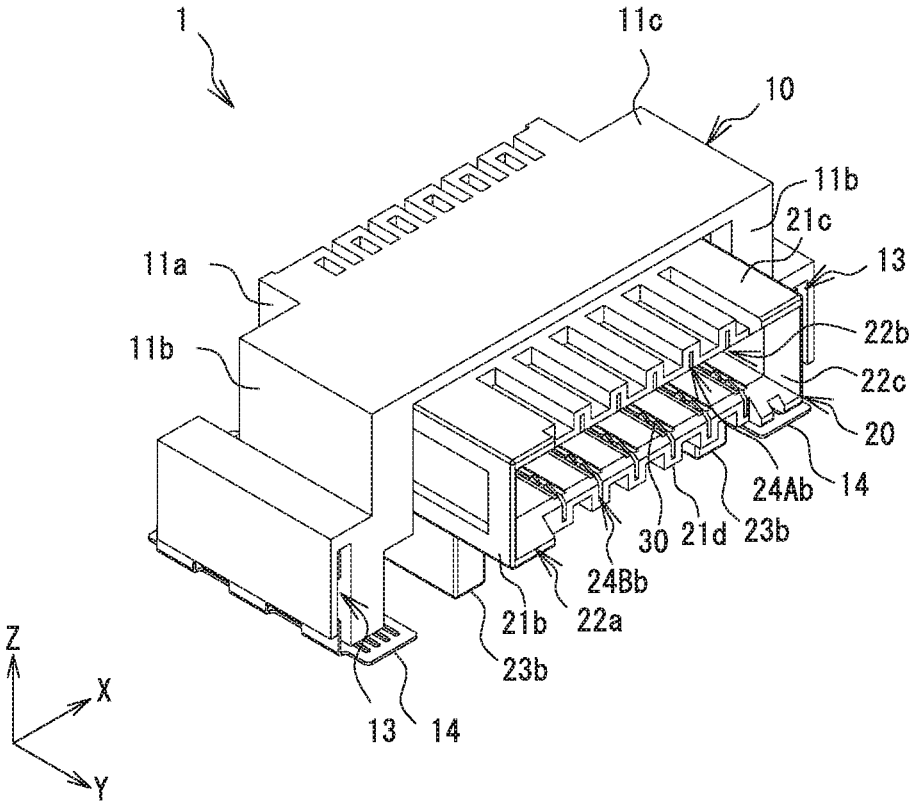
FIG. 1 is an external perspective view including a front surface, a left side surface, and a plan surface of a movable connector according to an embodiment.

The words "first" and "second" stated in this specification and Claims are used to discriminate different components in the present invention, and are not used to indicate a particular order or an inferior-to-superior relationship. For the sake of convenience, description in this specification and Claims is made on an assumption that, as represented in FIG. 1 and so on, a long-side direction (width direction or left-right direction) of the movable connector 1 is an X-direction, a short-side direction (depth direction or front-rear direction) is a Y-direction, and a height direction (up-down direction) is a Z-direction. The side closer to the substrate P (see FIGS. 6 to 9) in the height direction of the movable connector 1 is called the "lower side", and the side closer to the movable connector 1 is called the "upper side". However, those definitions are not purported to limit a fitting direction of the movable connector 1 and a manner of mounting the movable connector 1 to the substrate P.

Movable Connector 1

As illustrated in FIG. 1, 2 and so on, the movable connector 1 includes a fixed housing 10, i.e., a "first housing" in Claims, a movable housing 20, i.e., a "second housing", into which the plug connector, i.e., the "connection target", is inserted, and a plurality of terminals 30 held by the fixed housing 10 and the movable housing 20. In the movable connector 1, the fixed housing 10 is fixed to the substrate P (see FIGS. 6 to 9), and terminals of the plug connector are inserted into the movable connector 1 from the front side in the depth direction (Y-direction) to establish fitting connection. In this embodiment, the terminals 30 are constituted by a plurality of upper terminals 30A (FIG. 4) and a plurality of lower terminals 30B (FIG. 5). For convenience of explanation, in this specification, the upper terminals 30A and the lower terminals 30B are collectively called the terminals 30 in some cases. The upper terminal 30A and the lower terminal 30B are common to each other in many constituent elements. Therefore, the constituent elements regarding the upper terminal 30A are described by suffixing an English capital letter "A", and the constituent elements regarding the lower terminal 30B are described by suffixing an English capital letter "B".

Each terminal 30 includes a movable piece 31 (31A, 31B) and a contact piece 32 (32A, 32B). The movable piece 31 supports the movable housing 20 in a displaceable way relative to the fixed housing 10. The contact piece 32 includes a front contact 33*a* (33Aa, 33Ba) and a rear contact 34*a* (34Aa, 34Ba), each called "contact point", which are contacted with the terminal of the plug connector for conductive connection. The movable connector 1 of this embodiment is featured in that the terminal 30 includes a plate-thickness-direction conversion portion 35 (35A, 35B) which interconnects the movable piece 31 and the contact piece 32, and in which a plate thickness direction and a plate width direction of the terminal 30 are reversed between the movable piece 31 and the contact piece 32, and a front elastic arm 33*b* (33Ab, 33Bb) and a rear elastic arm 34*b* (34Ab, 34Bb), i.e., "elastic arms", which press the front contact 33*a* and the rear contact 34*a* in a direction crossing the plate thickness direction of the contact piece 32 to be contacted with the terminal of the plug connector.

Fixed Housing 10

The fixed housing 10 is a molded body made of insulating resin. As illustrated in FIG. 1, the fixed housing 10 is formed in such a rectangular parallelepiped shape that a depth size (Y-direction) and a height size (Z-direction) are smaller than a width size (X-direction). The fixed housing 10 includes a rear surface portion 11*a*, left and right lateral surface portions 11*b* and 11*b*, and a top surface portion 11*c*. The front side and the lower side of the fixed housing 10 are opened forward and downward, respectively. A receiving chamber 11*d* where the movable housing 20 is to be arranged is formed inside the fixed housing 10, i.e., in an inner space surrounded by the rear surface portion 11*a*, the left and right lateral surface portions 11*b* and 11*b*, and the top surface portion 11*c*.

In inner surfaces of the left and right lateral surface portions 11*b* and 11*b*, cutouts 11*e* and 11*e* are formed in a rectangular shape in bottom view by cutting the inner surfaces outward in the long-side direction of the fixed housing 10. Thus, front engagement walls 11*f* and 11*f* are formed respectively at front ends of the left and right lateral surface portions 11*b* and 11*b* to extend downward from the top surface portion 11*c* and toward the inside in the long-side direction.

The cutouts 11*e* are each surrounded in bottom view by three sides that are defined by the rear surface portion 11*a*, the left or right lateral surface portion 11*b*, and the front engagement wall 11*f*. The fixed housing 10 restricts movement of the movable housing 20 in the front-rear direction by the front engagement walls 11*f* and 11*f* and the rear surface portion 11*a*, and restricts movement of the movable housing 20 in the left-right direction by the left and right lateral surface portions 11*b* and 11*b*. Furthermore, the fixed housing 10 restricts movement of the movable housing 20 in the upward direction by the top surface portion 11*c*.

Figure 2:
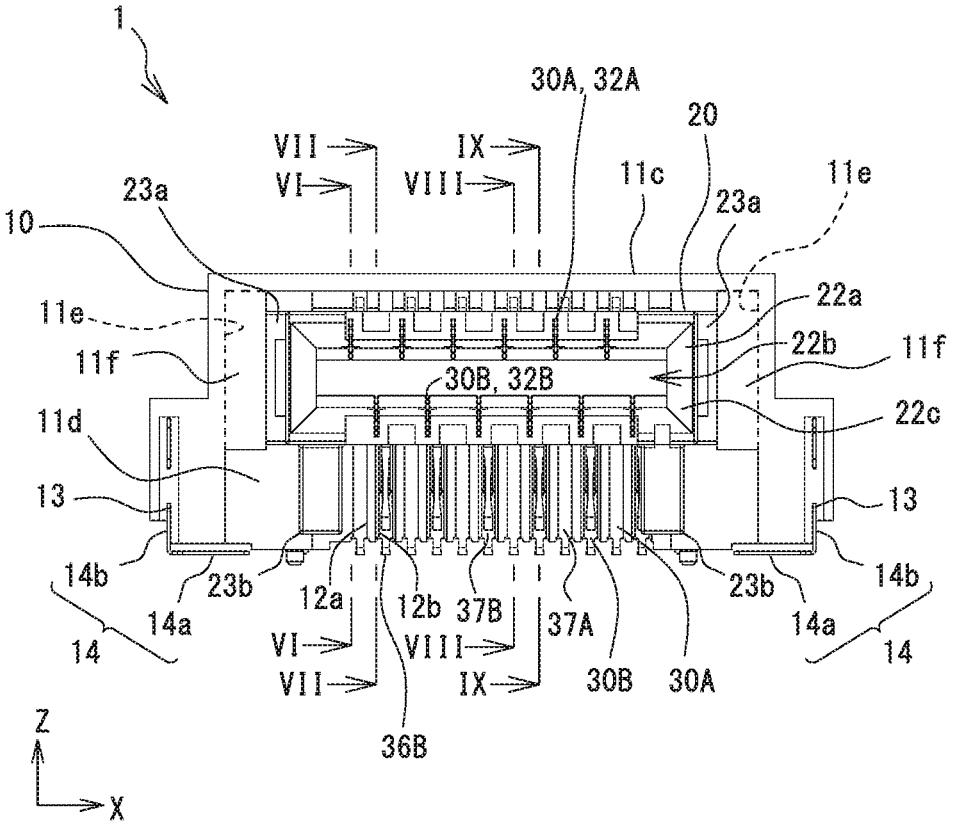
FIG. 2 is a front view of the movable connector illustrated in FIG. 1.

In this embodiment, the upper terminals 30A and the lower terminals 30B are alternately arranged in the left-right direction of the movable connector 1 (see FIG. 2). Corresponding to the upper terminals 30A and the lower terminals 30B, respectively, upper-terminal fixing grooves 12*a* and lower-terminal fixing grooves 12*b*, each groove being cut in the depth direction of the movable housing 20 and extending in the up-down direction, are provided in an inner surface of the rear surface portion 11*a* alternately in the left- and right direction. The upper-terminal fixing grooves 12*a* are to fix the upper terminals 30A to the fixed housing 10, and the lower-terminal fixing grooves 12*b* are to fix the lower terminals 30B to the fixed housing 10. Each upper-terminal fixing groove 12*a* (see FIG. 8) and each lower-terminal fixing groove 12*b* are formed such that their widths in the left-right direction are substantially the same, while the lower-terminal fixing groove 12*b* (see FIG. 9) is deeper in the depth direction.

The left and right lateral surface portions 11*b* and 11*b* include respectively fixing-member fixing grooves 13 and 13. Each fixing-member fixing groove 13 is to attach a fixing member 14 to the fixed housing 10. Though not illustrated, the fixing-member fixing groove 13 is hollowed in a wall of the left or right lateral surface portion 11*b* in a C-like shape bifurcated into two branches on the front side in side view.

The movable connector 1 includes the fixing member 14 for fixing the fixed housing 10 to the substrate P. The fixing member 14 can be formed, for example, by bending a metal plate into an L-shape. The fixing member 14 includes a substrate-side fixing piece portion 14*a* formed by one bent leg of the L-shape plate, and a fixed-housing-side fixing piece portion 14*b* formed by the other leg (see FIG. 2). In a state that the fixing member 14 is attached to the substrate P and the fixed housing 10, the substrate-side fixing piece portion 14*a* extends along a substrate mounted surface (XY-plane) and the fixed-housing-side fixing piece portion 14*b* extends in the front-rear direction and the height direction (YZ-plane) of the movable connector 1. The fixing members 14 and 14 each having the above-described configuration are arranged respectively on both sides of the fixed housing 10 in the width direction.

The substrate-side fixing piece portion 14*a* is soldered to the substrate P. A plurality of corner-rounded rectangular holes each extending in the front-rear direction (Y-direction) are formed in the substrate-side fixing piece portion 14*a* to increase an soldering area and to reduce weight.

Corresponding to the fixing-member fixing groove 13, though not illustrated, the fixed-housing-side fixing piece portion 14*b* is formed in a C-like shape bifurcated into two branches on the front side in side view. The fixing member 14 can be firmly attached to the fixed housing 10 by inserting the fixed-housing-side fixing piece portion 14*b* into the fixing-member fixing groove 13 from the backside of the fixed housing 10. The fixing member 14 is constituted such that, when attached to the fixed housing 10, the substrate-side fixing piece portion 14*a* is positioned lower than the bottom of the fixed housing 10. Accordingly, the fixed housing 10 is in a state floating from the substrate P when it is attached to the substrate P. The substrate-side fixing piece portion 14*a* is formed to have a longer length than each of the left and right lateral surface portions 11*b* and 11*b* in the front-rear direction, and to project into the receiving chamber 11*d* from a bottom surface of each of the left and right lateral surface portions 11*b* and 11*b*. As described later, the movable connector 1 is of the right-angle type that the connection target is inserted along a surface of the substrate P, and force applied for inserting the connection target strongly acts to separate the substrate-side fixing piece portion 14*a* from the substrate P. Particularly, strong insertion force acts in the movable connector 1 for the reason that the upper terminal 30A and the lower terminal 30B are arranged in vertically spaced relation, and that each terminal 30 is of two-contact type generating insertion forces at the front contact 33*a* and the rear contact 34*a*. However, because the substrate-side fixing piece portion 14*a* has a larger area than a bottom surface of each of the left and right lateral surface portions 11*b* and 11*b*, the movable connector 1 is reliably fixed to the substrate P even when the strong insertion force acts. On the other hand, because the substrate-side fixing piece portion 14*a* does not project laterally outward of each of the left and right lateral surface portions 11*b* and 11*b* in the width direction X, an area occupying the substrate P by the movable connector 1 can be reduced.

Movable Housing 20

As illustrated in FIG. 1, the movable housing 20 is formed in a smaller external shape than an internal shape of the fixed housing 10. The movable housing 20 is arranged in the receiving chamber 11*d*, which is surrounded by the rear surface portion 11*a*, the left and right lateral surface portions 11*b* and 11*b*, and the top surface portion 11*c* of the fixed housing 10, to be movable in the left-right direction, the front-rear direction, and in the up-down direction relative to the fixed housing 10. In a state that the fixed housing 10 and the movable housing 20 are assembled, a substantially front half of the movable housing 20 projects forward from a front end of the fixed housing 10.

Figure 3:
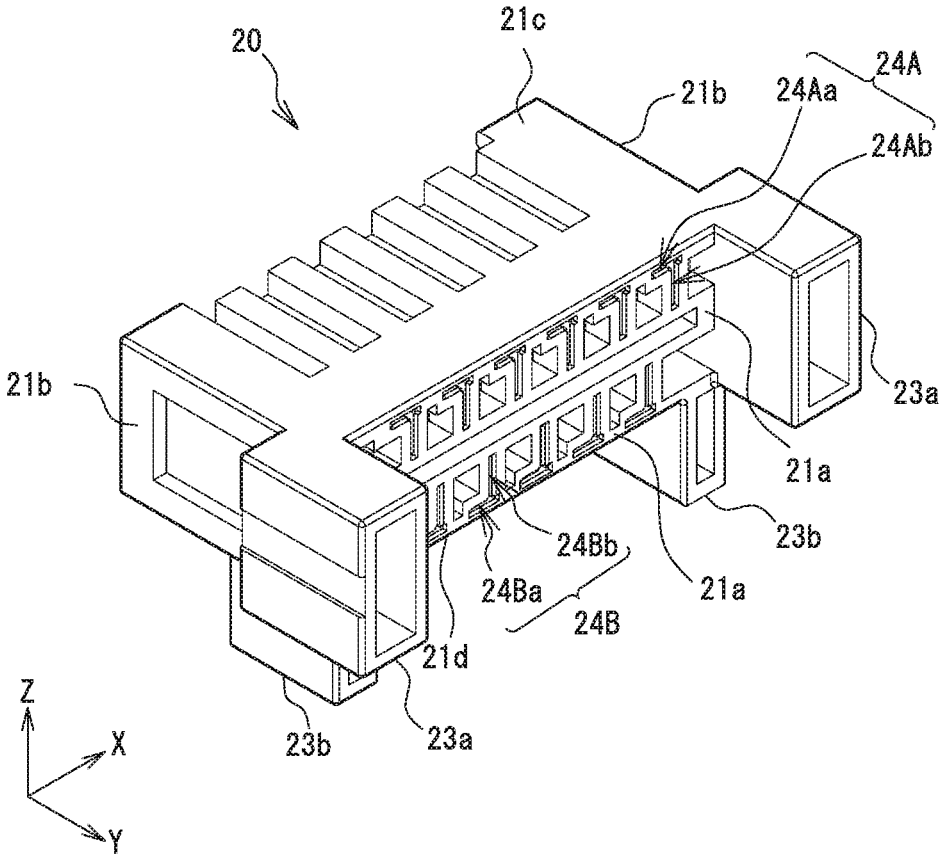
FIG. 3 is an external perspective view including a rear surface, a right side surface, and a plan surface of a movable housing.

The movable housing 20 is a molded body made of insulating resin. As illustrated in FIG. 3, the movable housing 20 is formed in such a rectangular parallelepiped shape that a depth size (Y-direction) and a height size (Z-direction) are smaller than a width size (X-direction). The movable housing 20 includes a rear surface portion 21*a*, left and right lateral surface portions 21*b* and 21*b*, a top surface portion 21*c*, and a bottom surface portion 21*d*.

The front side of the movable housing 20 is opened forward to define an insertion opening 22*a* for the terminals of the plug connector. The insertion opening 22*a* is formed in a horizontally elongate shape extending in a width direction of the plug connector. A fitting connection chamber 22*b* into which the terminals of the plug connector are inserted through the insertion opening 22*a* is formed as an inner space of the movable housing 20, the inner space being surrounded by the rear surface portion 21*a*, the left and right lateral surface portions 21*b* and 21*b*, the top surface portion 21*c*, and the bottom surface portion 21*d*. The plug connector is inserted into the fitting connection chamber 22*b* along a planar direction of a mounting surface of the substrate P to which the fixed housing 10 is mounted. Thus, the movable connector 1 is a connector of the so-called right-angle type that a fitting surface is perpendicular to the mounting surface when mounted.

An insertion guide slope 22*c* having a funnel-like shape is formed at a peripheral edge of the insertion opening 22*a*. Even when the plug connector is displaced from a center of the insertion opening 22*a* in the X-Z direction at the time of fitting and connecting the plug connector, it can be smoothly inserted into the fitting connection chamber 22*b* while being guided by the insertion guide slope 22*c*.

The movable housing 20 includes engagement shoulder portions 23*a* and 23*a* and engagement leg portions 23*b* and 23*b* in one-to-one relation to each of the left and right sides. The engagement shoulder portions 23*a* and 23*a* and the engagement leg portions 23*b* and 23*b* have functions of restricting the movements of the movable housing 20 relative to the fixed housing 10.

The engagement shoulder portions 23*a* and 23*a* are formed corresponding to the cutouts 11*e* and 11*e* of the fixed housing 10, respectively. The engagement shoulder portions 23*a* and 23*a* are projected rearward and outward in the width direction on both sides from the rear surface portion 21*a* and the left and right lateral surface portions 21*b* and 21*b*. Furthermore, the engagement shoulder portions 23*a* and 23*a* are formed in a rectangular shape in bottom view, which is smaller than the rectangular shape of the cutouts 11*e* and 11*e* each surrounded by three sides that are defined by the rear surface portion 11*a*, the left or right lateral surface portion 11*b*, and the front engagement wall 11*f*. The engagement shoulder portions 23*a* and 23*a* restrict the movement of the movable housing 20 in the front-rear direction by abutting against the front engagement walls 11*f* and the rear surface portion 11*a*. Moreover, the engagement shoulder portions 23*a* and 23*a* restrict the movement of the movable housing 20 in the left-right direction by abutting against the left and right lateral surface portions 11*b* and 11*b*.

The engagement leg portions 23*b* and 23*b* are each formed in a rectangular shape in bottom view and projected downward from the bottom surface portion 21*d*. An overall height of the movable housing 20 is given by a size from a lower end of the engagement leg portion 23*b* to an upper end of the top surface portion 21*c*. In addition, the overall height of the movable housing 20 is smaller than a size from the substrate P to an upper end of the fixed housing 10 on the lower surface side of the top surface portion 11*c*. Accordingly, when the movable connector 1 is mounted to the substrate P, spaces are formed between the top surface portion 11*c* of the fixed housing 10 and the top surface portion 21*c* of the movable housing 20 and between the engagement leg portion 23*b* and the substrate P (see FIGS. 6 to 9, etc.). The engagement leg portions 23*b* and 23*b* restrict the downward movement of the movable housing 20 by abutting against the substrate P.

The upward movement of the movable housing 20 is restricted by the top surface portion 21*c* of the movable housing 20 abutting against the top surface portion 11*c* of the fixed housing 10.

Figure 10:
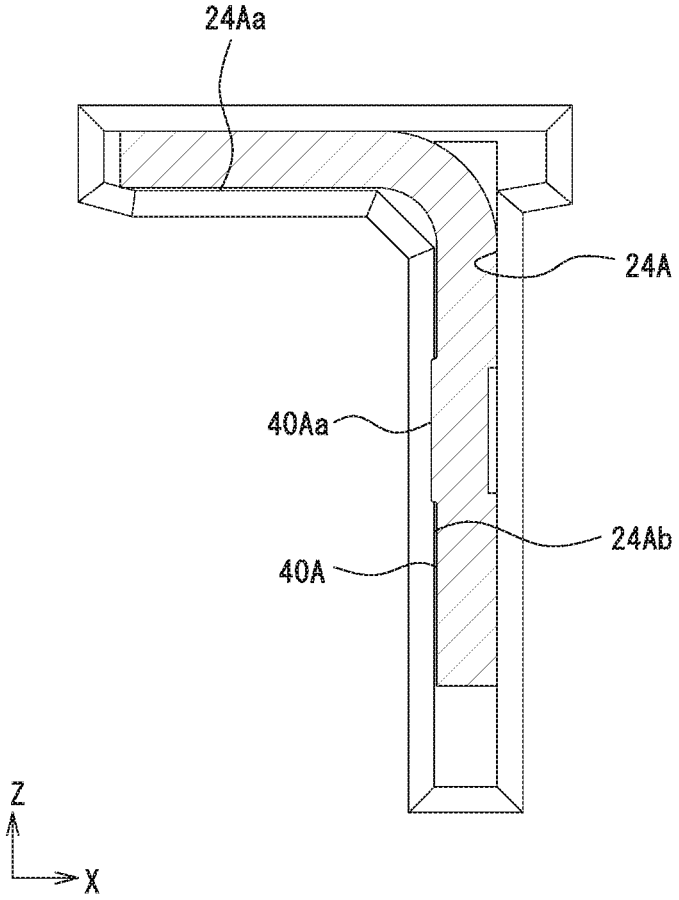
FIG. 10 is a partial enlarged sectional view looking, from the rear side, an upper terminal receiving portion into which the upper terminal is received.

The movable housing 20 includes terminal receiving portions 24 (24A, 24B) each having a bent groove-like shape and receiving the plate-thickness-direction conversion portion 35 and the contact piece 32 (see FIGS. 3 and 10). Since the terminals 30 in the movable connector 1 of this embodiment are constituted by the plurality of upper terminals 30A and the plurality of lower terminals 30B, the terminal receiving portions 24 include a plurality of upper terminal receiving portions 24A and a plurality of lower terminal receiving portions 24B correspondingly (see FIG. 3).

The upper terminal receiving portion 24A is formed in walls of the rear surface portion 21*a* and the top surface portion 21*c* to extend from the rear surface portion 21*a* in the front-rear direction. On the other hand, the lower terminal receiving portion 24B is formed in the walls of the rear surface portion 21*a* and the bottom surface portion 21*d* to extend from the rear surface portion 21*a* in the front-rear direction. Thus, the upper terminal 30A and the lower terminal 30B are fixed by being press-fitted respectively into the upper terminal receiving portion 24A and the lower terminal receiving portion 24B from the backside of the rear surface portion 21*a*. The upper terminal receiving portions 24A and the lower terminal receiving portions 24B are alternately provided in the left-right direction and are arranged such that an array interval of the upper terminal receiving portions 24A and an array interval of the lower terminal receiving portions 24B are displaced by a half of each array interval in the left-right direction.

The upper terminal receiving portion 24A includes a movable-piece-side receiving portion 24Aa and a contact-piece-side receiving portion 24Ab, and it is formed in an inverted L-shape (bent groove-like shape) having two sides in right-angled positional relation in rear view (see FIG. 10). The movable-piece-side receiving portion 24Aa extends along the left-right direction of the movable housing 20, and the contact-piece-side receiving portion 24Ab extends along the up-down direction of the movable housing 20. In other words, the movable-piece-side receiving portion 24Aa is formed along the XY-plane, and the contact-piece-side receiving portion 24Ab is formed along the YZ-plane. The movable-piece-side receiving portion 24Aa does not penetrate through the movable housing 20, and its front end is positioned in the wall of the top surface portion 21*c*. On the other hand, the contact-piece-side receiving portion 24Ab penetrates through the movable housing 20 and is communicated with the fitting connection chamber 22*b*. With the above-described structure, the movable piece 31 can be reliably fixed in place by the movable housing 20, and the contact piece 32 can be contacted with the terminal of the plug connector that is inserted into the fitting connection chamber 22*b* (see FIG. 6).

The lower terminal receiving portion 24B includes a movable-piece-side receiving portion 24Ba and a contact-piece-side receiving portion 24Bb, and it is formed in an inverted L-shape (bent groove-like shape) having two sides in right-angled positional relation in rear view. With respect to the fitting connection chamber 22*b*, the movable-piece-side receiving portion 24Ab of the upper terminal receiving portion 24A is opened downward from the top surface portion 21*c* while the contact-piece-side receiving portion 24Bb of the lower terminal receiving portion 24B is opened upward from the bottom surface portion 21*d* (see FIG. 1). In other points, the movable-piece-side receiving portion 24Ba and the contact-piece-side receiving portion 24Bb are similar to the movable-piece-side receiving portion 24Aa and the contact-piece-side receiving portion 24Ab, respectively.

Terminal 30

The terminals 30 are each an electrical conductor formed of a conductive metal piece. In this embodiment, as described above, the terminals 30 are constituted by the plurality (e.g., six) of upper terminals 30A and the plurality (e.g., six) of lower terminals 30B. Because the upper terminal 30A and the lower terminal 30B are similar in structure, the upper terminal 30A is mainly described here, and the lower terminal 30B is described mainly about different points from the upper terminal 30A.

Figure 4:
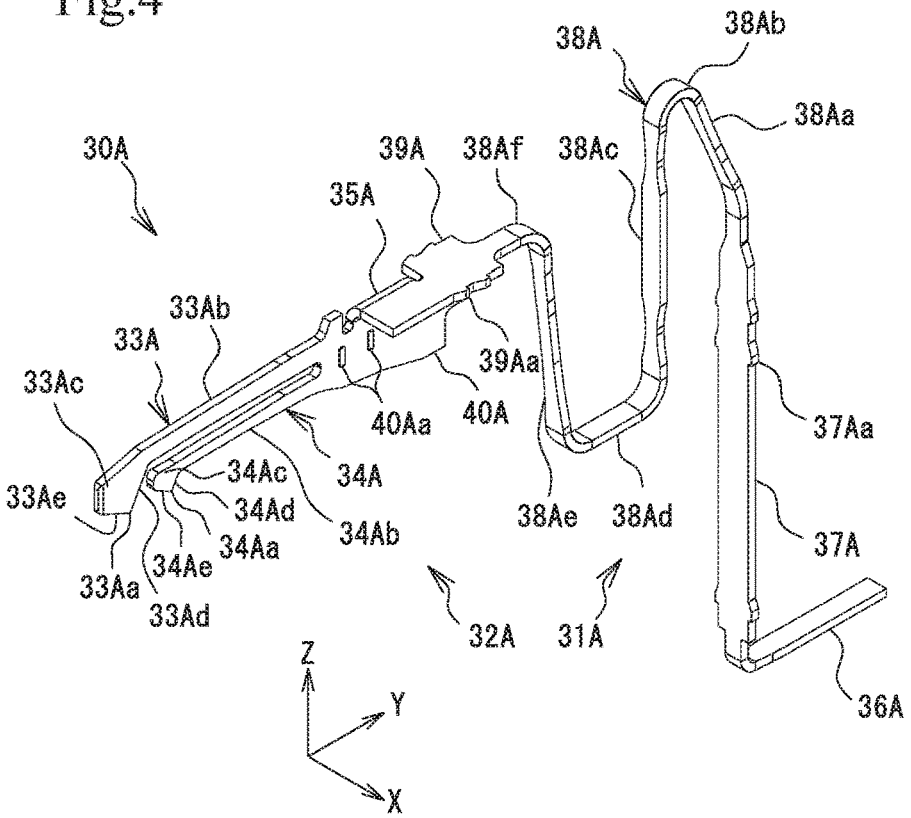
FIG. 4 is an external perspective view including a front surface, a right side surface, and a plan surface of an upper terminal.
Figure 5:
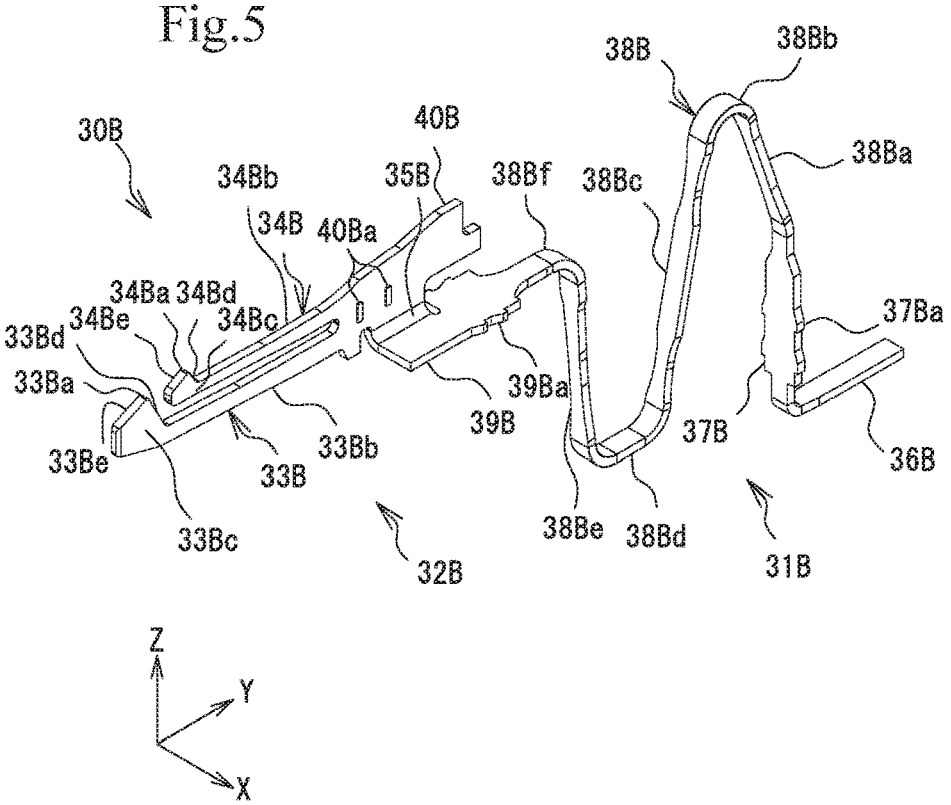
FIG. 5 is an external perspective view including a front surface, a right side surface, and a plan surface of a lower terminal.

As illustrated in FIG. 4, the upper terminal 30A includes a substrate connection portion 36A, the movable piece 31A, the plate-thickness-direction conversion portion 35A, and the contact piece 32A in sequence from the one end side. The upper terminal 30A having a different function for each portion is formed as a single component by punching a conductive metal piece in the form of a flat plate, which is used as a material, into an elongate plate, and then by bending the elongate plate.

The substrate connection portion 36A is a portion of the upper terminal 30A including its one end, and is to connect the upper terminal 30A to a circuit on the substrate P for conductive connection and to fix the upper terminal 30A to the substrate P. In a state that the upper terminal 30A is attached to the fixed housing 10, one end of the substrate connection portion 36A is projected up to a position behind the rear surface of the fixed housing 10 on the lower side thereof (see FIG. 8). The substrate connection portion 36A, mainly its lower plate surface, and the upper surface of the substrate P are soldered to each other (see FIG. 8).

The movable piece 31A includes a fixed-housing-side base portion 37A, a movable spring portion 38A, i.e., a "movable portion", and a movable-housing-side base portion 39A.

The fixed-housing-side base portion 37A is to fix the upper terminal 30A to the fixed housing 10. The fixed-housing-side base portion 37A is bent at a front end of the substrate connection portion 36A extending in the front-rear direction of the fixed housing 10, and extends upward along the height direction. At both lateral edges of the fixed-housing-side base portion 37A in a plate-width direction (X-direction), press-fitting projections 37Aa are formed to project outward in the plate-width direction. The press-fitting projections 37Aa are press-fitted and engaged into the upper-terminal fixing groove 12*a* formed in the rear surface portion 11*a* of the fixed housing 10, whereby the upper terminal 30A is fixed to the fixed housing 10 (see FIG. 2).

Figure 8:
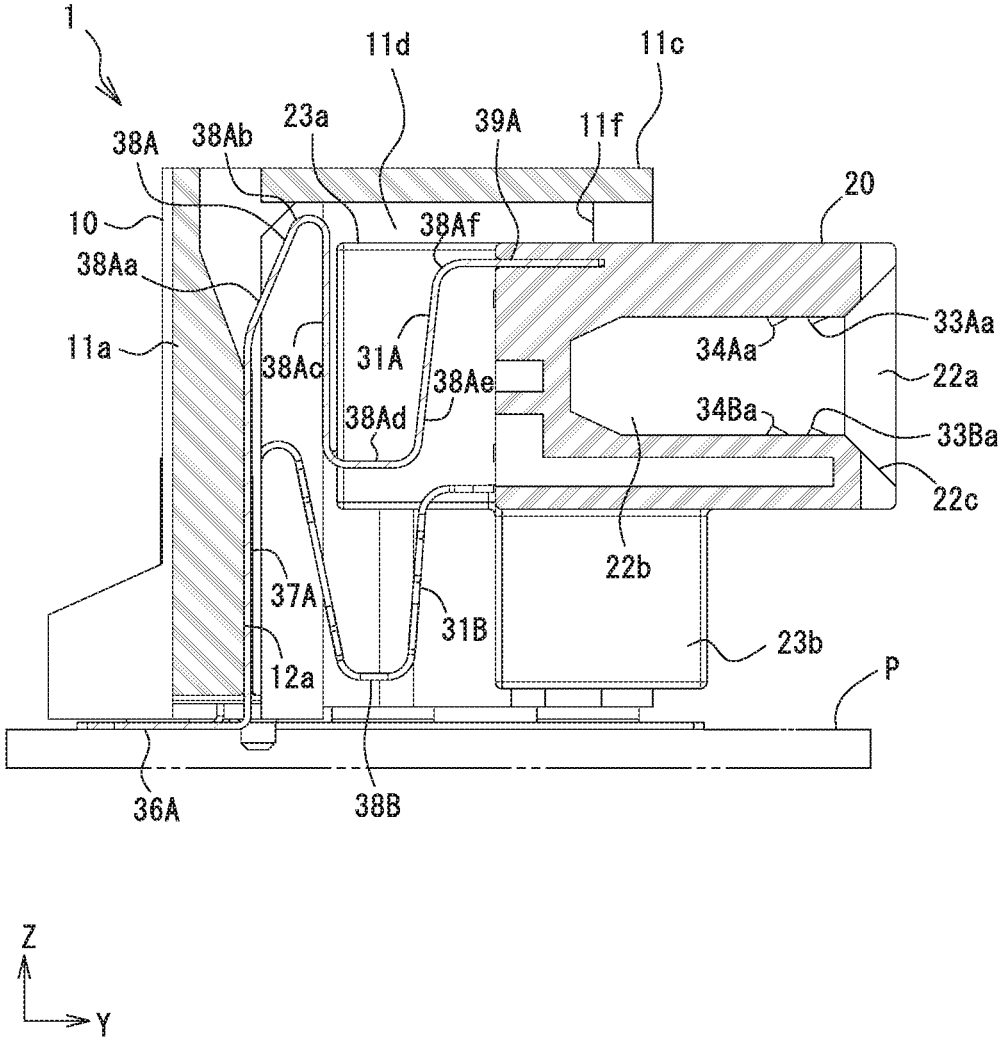
FIG. 8 is a sectional view taken along line VIII-VIII in FIG. 2.

The movable spring portion 38A has a floating function of supporting the movable housing 20 in a three-dimensionally displaceable manner relative to the fixed housing 10. As illustrated in FIGS. 4 and 8, the movable spring portion 38A includes a first vertical piece portion 38Aa, i.e., a "vertical piece portion", a first bent portion 38Ab, i.e., a "bent portion", a second vertical piece portion 38Ac, i.e., a "vertical piece portion", a second bent portion 38Ad, i.e., a "bent portion", a third vertical piece portion 38Ae, i.e., a "vertical piece portion", and a third bent portion 38Af, i.e., a "bent portion", in sequence from the side closer to the fixed-housing-side base portion 37A.

The first vertical piece portion 38Aa extends obliquely upward from the fixed-housing-side base portion 37A toward the front side of the upper terminal 30A in the front-rear direction. The first bent portion 38Ab is curved from an upper end of the first vertical piece portion 38Aa into an inverted U-shape in side view. The second vertical piece portion 38Ac extends downward from the first bent portion 38Ab parallel to the fixed-housing-side base portion 37A. The second bent portion 38Ad is folded at a lower end of the second vertical piece portion 38Ac into a U-shape. The third vertical piece portion 38Ae extends obliquely upward from the second bent portion 38Ad toward the front side. The third bent portion 38Af is curved from an upper end of the third vertical piece portion 38Ae toward the front side, and then extends parallel to a direction in which the plug connector is inserted into the fitting connection chamber 22*b*.

Thus, the movable spring portion 38A of the movable piece 31A is formed in a "vertically-vibrating wave shape" including a plurality of "vertical piece portions" each extending in a direction crossing the direction in which the plug connector is inserted into the fitting connection chamber 22*b*, and a "bent portion" interconnecting ends of the "vertical piece portions" adjacent to each other.

The first vertical piece portion 38Aa is inclined toward the front side more steeply than the third vertical piece portion 38Ae to provide a space allowing the first vertical piece portion 38Aa to be displaced rearward when the plug connector is inserted. Furthermore, the first vertical piece portion 38Aa is formed in a narrower plate width near a middle region than upper and lower ends to distribute stress upon receiving a load, and to prevent the first vertical piece portion 38Aa from being deformed to a large extent particularly near a joined point to the fixed-housing-side base portion 37A.

The first bent portion 38Ab is positioned away from the space where the movable housing 20 is arranged inside the fixed housing 10, and is located at a level above the third bent portion 38Af, thereby ensuring an appropriate spring length. The second bent portion 38Ad is formed in a relatively long length in the insertion direction of the plug connector to make the influence of displacement of the movable housing 20 less spread to the second vertical piece portion 38Ac. Therefore, strength and durability of the second vertical piece portion 38Ac can be enhanced even when the second vertical piece portion 38Ac is prolonged to ensure the appropriate spring length. Moreover, because the second vertical piece portion 38Ac is formed in a narrower plate width at upper and lower ends, stresses generated in the first bent portion 38Ab and the second bent portion 38Ad both adjacent to the second vertical piece portion 38Ac can be distributed. In addition, because the second vertical piece portion 38Ac is formed in a wider plate width near a middle region than the upper and lower ends, strength and durability of the second vertical piece portion 38Ac can be further enhanced even when the second vertical piece portion 38Ac is prolonged to ensure the appropriate spring length.

The third vertical piece portion 38Ae is inclined toward the front side to provide an obtuse angle between itself and each of the second bent portion 38Ad and the third bent portion 38Af adjacent thereto. It is hence possible to further increase pliability and durability of those bent portions, which serve as springs, particularly in the height direction. Furthermore, the third vertical piece portion 38Ae is formed in a narrower plate width near a middle region than upper and lower ends, the influence of displacement of the movable housing 20 is made less spread to particularly the second bent portion 38Ad when receiving a load.

The movable spring portion 38A has a narrower plate width than the other portions of the upper terminal 30A, such as the fixed-housing-side base portion 37A, the movable-housing-side base portion 39A, and the contact piece 32A. In the movable spring portion 38A, the first vertical piece portion 38Aa and the third vertical piece portion 38Ae are formed in narrower plate widths than the first bent portion 38Ab and the second bent portion 38Ad. Accordingly, the movable spring portion 38A can develop appropriate pliability as a spring for elastically supporting three-dimensional displacements of the movable housing 20.

In the movable spring portion 38A, since the three vertical piece portions extending in the up-down direction, i.e., the first vertical piece portion 38Aa, the second vertical piece portion 38Ac, and the third vertical piece portion 38Ae, are arranged in parallel, the appropriate spring length is ensured without enlarging a space of the receiving chamber 11*d* particularly in the front-rear direction. Thus, because of including the plurality of vertical piece portions extending in the direction crossing the insertion direction of the plug connector into the fitting connection chamber 22*b*, the movable spring portion 38A can pliably support the movable housing 20 that is displaced particularly in the front-rear direction, and can enhance durability as a spring. The movable spring portion 38A may include the above-described vertical piece portion in a larger number, e.g., five. This makes it possible to more pliably support the movable housing 20 that is displaced particularly in the front-rear direction, and to further enhance durability as a spring.

The movable-housing-side base portion 39A is to fix the upper terminal 30A to the movable housing 20. The movable-housing-side base portion 39A extends forward straightly from a front end of the third bent portion 38Af extending in the front-rear direction of the movable housing 20. At both lateral edges of the movable-housing-side base portion 39A in a plate-width direction (X-direction), press-fitting projections 39Aa, i.e., "fixing portions", are formed to project outward in the plate-width direction. The press-fitting projections 39Aa are each press-fitted and engaged into the movable-piece-side receiving portion 24Aa of the upper terminal receiving portion 24A that is formed in the rear surface portion 21*a* of the movable housing 20, whereby the upper terminal 30A is fixed to the movable housing 20 (see FIG. 2).

Thus, the press-fitting projections 39Aa for fixing the movable piece 31A of the upper terminal 30A to the movable housing 20 are disposed between the plate-thickness-direction conversion portion 35A and the movable spring portion 38A. Therefore, stress attributable to displacement or deformation generated in one of the plate-thickness-direction conversion portion 35A and the movable spring portion 38A can be prevented from being transmitted to the other by the presence of the press-fitting projections 39Aa that are positioned between those two portions and serve as fixing points to the movable housing 20. Furthermore, the plate-thickness-direction conversion portion 35A and the movable spring portion 38A can be independently displaced without physically affecting each other by the presence of the movable-housing-side base portion 39A that is firmly fixed to the movable housing 20 using the press-fitting projections 39Aa. As a result, stress generated in one of the above two portions can be avoided from causing deformation of the other portion, and hence the movable connector 1 can realize stable connection for conductive connection to the terminal of the plug connector.

The movable piece 31A is arranged in the fixed housing 10 and the movable housing 20 such that the plate width direction of the movable piece 31A is aligned with the long-side direction (X-direction) of the movable connector 1, and that the plate thickness direction of the movable piece 31A is aligned with the short-side direction (Y-direction) and the height direction (Z-direction) of the movable connector 1. On the other hand, the contact piece 32A is arranged in the movable housing 20 such that the plate width direction of the contact piece 32A is aligned with the height direction (Z-direction) of the movable connector 1, and that the plate thickness direction of the contact piece 32A is aligned with the long-side direction (X-direction) of the movable connector 1. The plate-thickness-direction conversion portion 35A has functions of coupling the movable piece 31A and the contact piece 32A, and reversing the plate thickness direction and the plate width direction of the upper terminal 30A between the movable piece 31A and the contact piece 32A.

The plate-thickness-direction conversion portion 35A is formed in a quarter-circular cylindrical shape curved at an internal angle of 90°, and is formed of a thin plate having a quarter-circular cross-section and extending in the front-rear direction of the upper terminal 30A. The plate-thickness-direction conversion portion 35A is joined to the front end side of the movable-housing-side base portion 39A of the movable piece 31A in the front-rear direction and to an intermediate region of a later-described contact-piece base portion 40A of the contact piece 32A, and it does not extend up to the rear end side of both the movable-housing-side base portion 39A and the contact-piece base portion 40A. A front end of the plate-thickness-direction conversion portion 35A and a front end of the movable-housing-side base portion 39A are formed in flush with each other. The plate-thickness-direction conversion portion 35A can be formed by bending one metal plate, including the movable piece 31A and the contact piece 32A formed by punching, at a right angle in a boundary portion between the movable piece 31A and the contact piece 32A.

Since the upper terminal 30A in this embodiment includes the plate-thickness-direction conversion portion 35A, the influence of the plate thickness of the movable piece 31A can be avoided from spreading to the contact piece 32A in spite of the movable piece 31A and the contact piece 32A being in the integral form. In other words, the movable piece 31A being relatively thin can be formed by using, as a metal plate for the upper terminal 30A, a material having a smaller plate thickness with intent to, for example, increase flexibility of the movable piece 31A.

Figure 6:
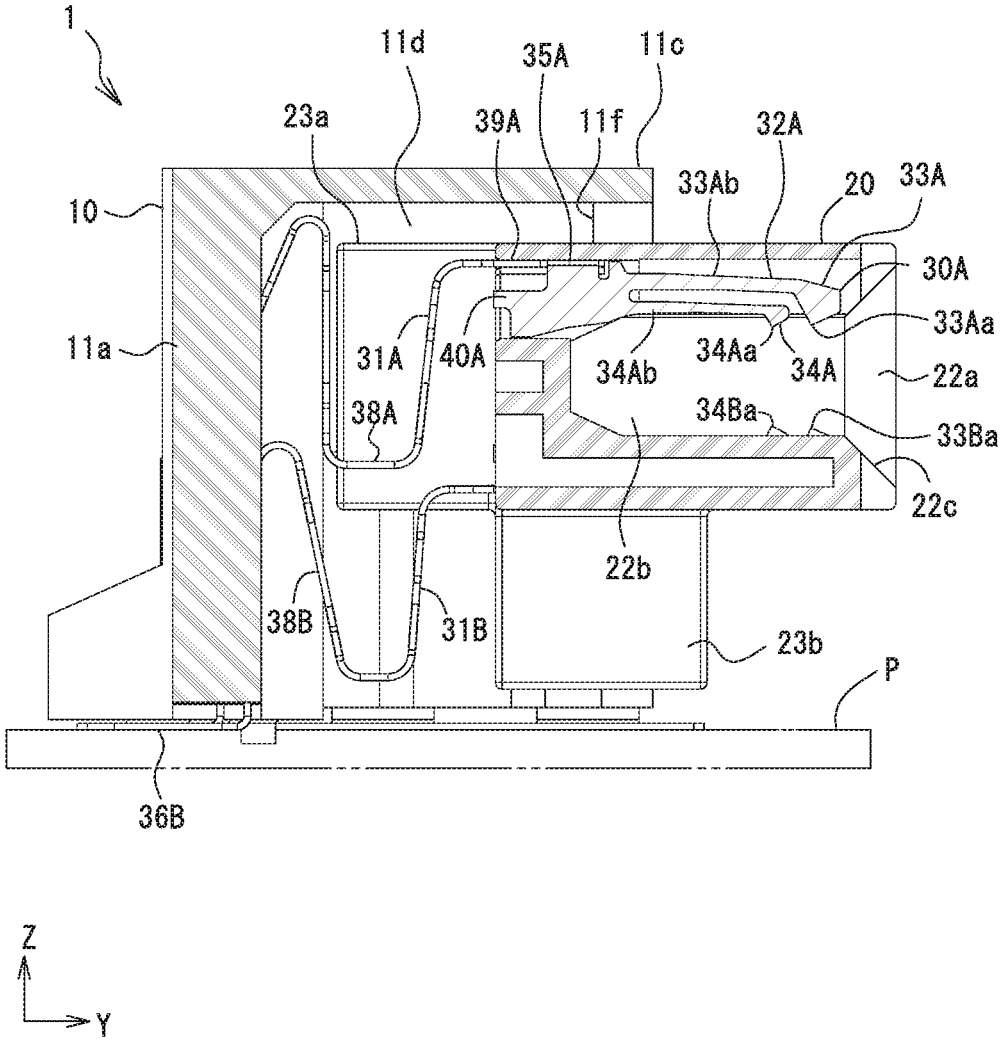
FIG. 6 is a sectional view taken along line VI-VI in FIG. 2.
Figure 7:
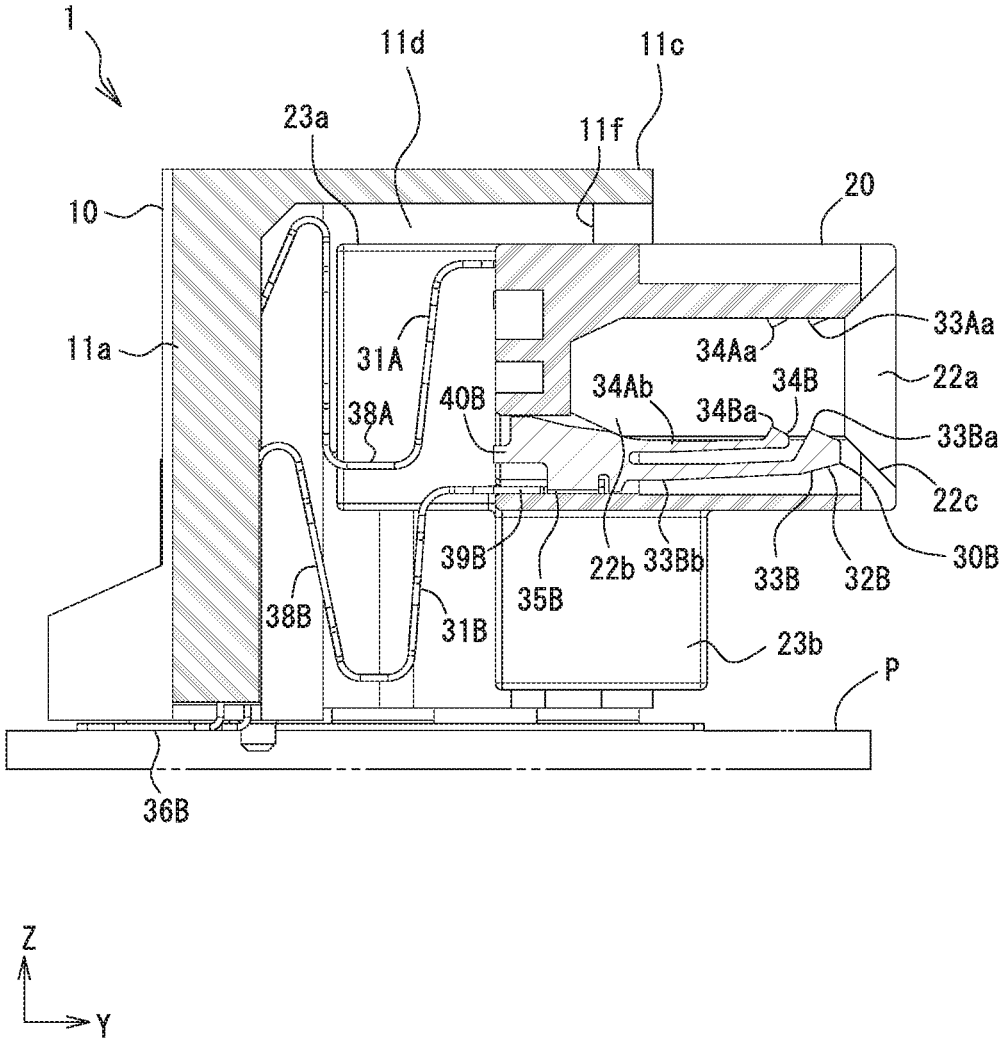
FIG. 7 is a sectional view taken along line VII-VII in FIG. 2.

The contact piece 32A is constituted in the form of a flat plate elongating in the front-rear direction (Y-direction) along a direction (YZ-plane) crossing the substrate mounting surface. The contact piece 32A is joined, at a lateral edge near a rear end, to the plate-thickness-direction conversion portion 35A. The contact piece 32A is received in the upper terminal receiving portion 24A in communication with the fitting connection chamber 22*b* of the movable housing 20, and is connected to the terminal of the plug connector for conductive connection. As illustrated in FIGS. 4 and 6, the contact piece 32A includes the contact-piece base portion 40A, a front contact portion 33A, and a rear contact portion 34A.

The contact-piece base portion 40A is positioned on the rear end side of the contact piece 32A and is joined to the plate-thickness-direction conversion portion 35A. The contact-piece base portion 40A is used for fixing the contact piece 32A to the movable housing 20. The contact-piece base portion 40A is in the form of a flat plate and extends in the front-rear direction of the upper terminal 30A.

The contact-piece base portion 40A includes press-fitting projections 40Aa projecting from a plate surface (YZ-plane) of the contact-piece base portion 40A in the plate thickness direction (X-direction). As illustrated in FIG. 4, the press-fitting projections 40Aa in this embodiment are each formed as a columnar boss having a bottom surface in a corner-rounded rectangular shape. The press-fitting projections 40Aa can be formed, for example, by pressing the contact-piece base portion 40A from the rear surface side, i.e., by the so-called embossing. The press-fitting projections 40Aa are press-fitted and fixed to the contact-piece-side receiving portion 24Ab of the upper terminal receiving portion 24A when the contact piece 32A is received into the upper terminal receiving portion 24A.

The contact piece 32A, the plate-thickness-direction conversion portion 35A, and the movable piece 31A are received in the upper terminal receiving portion 24A. However, an angle (bent angle) between the contact piece 32A and the movable piece 31A both formed by bending is different from an angle between the contact-piece-side receiving portion 24Ab and the movable-piece-side receiving portion 24Aa of the upper terminal receiving portion 24A in some cases. Furthermore, a gap is present around the contact piece 32A received in the upper terminal receiving portion 24A. In such a state, there is a possibility that the contact piece 32A is received into the contact-piece-side receiving portion 24Ab in inclining, and that the connection for conductive connection between each of a front contact point 33Aa and a rear contact point 34Aa and the terminal of the plug connector may become unstable.

In the movable connector 1 of this embodiment, however, the press-fitting projections 40Aa are press-fitted and fixed to the upper terminal receiving portion 24A. Therefore, when the upper terminal 30A is attached to the movable housing 20, stress generated upon the press-fitting projections 40Aa coming into pressure contact with the upper terminal receiving portion 24A acts to deform the plate-thickness-direction conversion portion 35A, thus enabling the contact piece 32A to be corrected into an appropriate posture. Accordingly, contact states between the terminal of the plug connector and both the front contact point 33Aa and the rear contact point 34Aa can be further stabilized.

As illustrated in FIG. 10, the press-fitting projection 40Aa in this embodiment has a shape projecting from the plate surface of the contact-piece base portion 40A in the plate thickness direction on the internal angle side relative to the contact-piece base portion 40A and the plate-thickness-direction conversion portion 35A. Such a shape causes the press-fitting projection 40Aa come into pressure contact on the internal angle side relative to the contact-piece base portion 40A and the plate-thickness-direction conversion portion 35A. Therefore, an internal angle between the plate-thickness-direction conversion portion 35A and the contact-piece base portion 40A, both tending to deform toward the side making the internal angle smaller, can be widened to correct the contact piece 32A into an appropriate posture. As a result, the contact states between the terminal of the plug connector and both the front contact point 33Aa and the rear contact point 34Aa can be further stabilized.

The press-fitting projection 40Aa is just required to be able to fix the contact-piece base portion 40A to the contact-piece-side receiving portion 24Ab by press-fitting, and to correct the contact piece 32A into the appropriate posture. Thus, the press-fitting projection 40Aa is not limited to the illustrated columnar boss having the bottom surface in the corner-rounded rectangular shape, and it may be formed in a circular or rectangular columnar shape. Furthermore, the number and layout of the press-fitting projections 40Aa are not limited to the illustrated ones, i.e., two and the layout where the two projections are arranged in spaced relation in the front-rear direction of the upper terminal 30A. In another example, a rectangular shape may be drawn on a plate surface of the contact-piece base portion 40A, and the press-fitting projection 40Aa may be arranged at each of four locations corresponding to corners of the drawn rectangular shape. However, two or more press-fitting projections 40Aa are preferably disposed at symmetric positions relative to a line extending in the front-rear direction while passing a center of the contact-piece base portion 40A in the plate width direction. With that layout, the contact-piece base portion 40A received in the contact-piece-side receiving portion 24Ab is less apt to wobble, thereby enabling the contact piece 32A to be corrected into the appropriate posture.

The press-fitting projection 40Aa may have a shape projecting from the plate surface of the contact-piece base portion 40A in the plate thickness direction on the external angle side relative to the contact-piece base portion 40A and the plate-thickness-direction conversion portion 35A. The press-fitting projection 40Aa projecting on the external angle side relative to the contact-piece base portion 40A and the plate-thickness-direction conversion portion 35A can be more easily manufactured in comparison with the press-fitting projection 40Aa projecting on the internal angle side because the former press-fitting projection is less apt to interfere with the movable piece 31A when machined.

The plate-thickness-direction conversion portion 35A is deformed when the upper terminal 30A is received into the upper terminal receiving portion 24A, thus absorbing a variation in angle between the movable piece 31A and the contact piece 32A (i.e., a difference in angle between the upper terminal receiving portion 24A and the upper terminal 30A). After the upper terminal 30A has been fixed to the upper terminal receiving portion 24A, the plate-thickness-direction conversion portion 35A may remain in a deformed state. Accordingly, displacement and deformation of the plate-thickness-direction conversion portion 35A include not only elastic deformation, but also plastic deformation. However, when deformation of the plate-thickness-direction conversion portion 35A falls within the range of elastic deformation, breakage or cracking is less apt to occur, and a load applied to the upper terminal 30A can be reduced.

The front contact portion 33A and the rear contact portion 34A have shapes extending from the common contact-piece base portion 40A parallel to each other in a U-like shape, and having fore ends that are projected toward one side in the plate width direction. Thus, each of the front contact portion 33A and the rear contact portion 34A has hook-like shape in side view.

The front contact portion 33A includes a front elastic arm 33Ab and a front contact point portion 33Ac. The front elastic arm 33Ab extends forward from the contact-piece base portion 40A along the insertion direction of the plug connector. The front elastic arm 33Ab supports, in a displaceable way, the front contact point 33Aa joined to the fore end side of the front elastic arm 33Ab. The front elastic arm 33Ab presses the front contact point 33Aa toward the lower side from the upper side in the up-down direction to be brought into pressure contact with the terminal of the plug connector.

The front contact point portion 33Ac includes, in sequence from the side closer to the front elastic arm 33Ab, a front backside edge 33Ad, the front contact point 33Aa, and a front contact edge 33Ae, which are formed on the lower side in the up-down direction to define a surface opposing to the terminal of the plug connector inserted into the fitting connection chamber 22*b*. The front backside edge 33Ad is joined to a front end of the front elastic arm 33Ab, and extends forward in the front-rear direction and downward in the up-down direction in side view. The front contact point 33Aa is joined to a front end of the front backside edge 33Ad and is formed in a circular-arc shape in side view. The front contact edge 33Ae is joined to a front end of the front contact point 33Aa, and extends forward in the front-rear direction and upward in the up-down direction in side view.

The front contact edge 33Ae and the front backside edge 33Ad are formed to have an obtuse internal angle of 95°, for example. Furthermore, parts of the front contact edge 33Ae and the front backside edge 33Ad, as well as the front contact point 33Aa are projected downward into the fitting connection chamber 22*b* from the contact-piece-side receiving portion 24Ab in the top surface portion 21*c* of the movable housing 20, and are brought into pressure contact with the terminal of the plug connector (see FIGS. 6 to 9). The front contact edge 33Ae has a function of removing a foreign matter adhering to the terminal of the plug connector.

The rear contact portion 34A has a similar configuration to that of the front contact portion 33A, and is disposed adjacent to the front contact portion 33A thereunder. A front end of the rear contact portion 34A is positioned behind the front contact point portion 33Ac of the front contact portion 33A in the front-rear direction of the upper terminal 30A. The rear contact portion 34A includes a rear elastic arm 34Ab and a rear contact point portion 34Ac. The rear elastic arm 34Ab extends forward from the contact-piece base portion 40A along the insertion direction of the plug connector. The rear elastic arm 34Ab supports, in a displaceable way, the rear contact point 34Aa joined to the front end side of the rear elastic arm 34Ab. The rear elastic arm 34Ab presses the rear contact point 34Aa toward the lower side from the upper side in the up-down direction to be brought into pressure contact with the terminal of the plug connector.

The rear contact point portion 34Ac includes, in sequence from the side closer to the rear elastic arm 34Ab, a rear backside edge 34Ad, the rear contact point 34Aa, and a rear contact edge 34Ae, which are formed on the lower side in the up-down direction to define a surface opposing to the terminal of the plug connector inserted into the fitting connection chamber 22*b*. The rear backside edge 34Ad is joined to a front end of the rear elastic arm 34Ab, and extends forward in the front-rear direction and downward in the up-down direction in side view. The rear contact point 34Aa is joined to a front end of the rear backside edge 34Ad and is formed in a circular-arc shape in side view. The rear contact point 34Aa is projected up to a position lower than the front contact point 33Aa in the up-down direction (see FIGS. 6 to 9). The rear contact edge 34Ae is joined to a front end of the rear contact point 34Aa, and extends forward in the front-rear direction and upward in the up-down direction in side view.

The rear contact edge 34Ae and the rear backside edge 34Ad are formed to have an obtuse internal angle of 91°, for example. Furthermore, parts of the rear contact edge 34Ae and the rear backside edge 34Ad, as well as the rear contact point 34Aa are projected downward into the fitting connection chamber 22*b* from the contact-piece-side receiving portion 24Ab in the top surface portion 21*c* of the movable housing 20, and are brought into pressure contact with the terminal of the plug connector (see FIGS. 6 to 9).

Contact pressure of the rear contact portion 34A is set to be higher than that of the front contact portion 33A. The spring constant of the rear contact portion 34A is also set to be higher than that of the front contact portion 33A. With those settings, the rear contact point 34Aa can be reliably brought into contact with the terminal of the plug connector even when the rear contact point 34Aa is positioned in the fitting connection chamber 22*b* on the deeper side than the front contact point 33Aa in the insertion direction. Accordingly, connection reliability of the rear contact portion 34A can be further enhanced.

In the movable connector 1 of this embodiment, when the plug connector is inserted into the movable connector 1, the front elastic arm 33*b* and the rear elastic arm 34*b* are elastically deformed in the direction crossing the plate thickness direction of the contact piece 32. Therefore, even with the plate thickness of the terminal 30 being reduced, the contact pressures at the front contact point 33*a* and the rear contact point 34*a* against the terminal of the plug connector are less apt to lower. In short, according to the movable connector 1 of this embodiment, vibration is more easily absorbed and stress is distributed in the movable piece 31, whereby durability is improved. Moreover, according to the movable connector 1 of this embodiment, slight sliding between each of the front contact point 33*a* and the rear contact point 34*a* and the terminal of the plug connector is less apt to occur in the contact piece 32.

For the purpose of preventing the slight sliding, it is conceivable to raise the contact pressures at the front contact point 33Aa and the rear contact point 34Aa by increasing the plate width of the upper terminal 30A. In the related-art connector using such a method, however, sizes of the front contact portion 33A and the rear contact portion 34A in the plate width direction are increased, and hence an overall connector size is increased. In contrast, in the movable connector 1 of this embodiment, the plate thickness directions of the contact piece 32A and the movable piece 31A are different in crossing relation. According to the movable connector 1 of this embodiment, therefore, even when the contact piece 32A is formed in a larger size in the plate thickness direction to ensure the contact pressure, the size of the upper terminal 30A can be suppressed from increasing in the plate width direction of the movable piece 31A (i.e., the plate thickness direction of the contact piece 32A).

Furthermore, in the movable connector 1 of this embodiment, the front contact point 33Aa and the rear contact point 34Aa are each formed in a plate-thickness defining surface that extends, at the outer edge of the contact piece 32A in the plate width direction, in the direction crossing the plate width direction of the contact piece 32A. Therefore, a contact area between each contact point and the terminal of the plug connector is smaller than that in the case of providing the front contact point 33Aa and the rear contact point 34Aa in, for example, the surface (rolled surface) of the contact piece 32A. Moreover, the contact pressures generated by elastic deformations of the front elastic arm 33Ab and the rear elastic arm 34Ab act to concentrate on the plate-thickness defining surfaces each having the smaller contact area. As a result, the movable connector 1 of this embodiment can strengthen force for holding the contact piece 32A on the terminal of the plug connector, and can make contact sliding less apt occur.

The movable connector 1 of this embodiment is not limited to the illustrated structure including two contact portions, i.e., the front contact portion 33A and the rear contact portion 34A. Similar advantageous effects can also be obtained even with a structure including one contact portion.

As illustrated in FIG. 5, the lower terminal 30B includes a substrate connection portion 36B, a movable piece 31B, a plate-thickness-direction conversion portion 35B, and a contact piece 32B in sequence from the one end side. The lower terminal 30B has a similar structure to that of the upper terminal 30A except for being different only in lengths of the substrate connection portion 36B and the movable piece 31B, an angle relative to the insertion direction of the plug connector, and except for being different only in directions of the plate-thickness-direction conversion portion 35B and the contact piece 32B relative to the movable piece 31B. The lower terminal 30B can provide similar advantageous effects to those of the upper terminal 30A.

The substrate connection portion 36B is formed in a shorter length than the substrate connection portion 36A. From the necessity of avoiding interference with the movable piece 31A of the upper terminal 30A, an upper region of the receiving chamber 11*d* cannot be utilized for the movable piece 31B of the lower terminal 30B, and the movable piece 31B has a difficulty in ensuring an appropriate spring length. For that reason, to compensate for the shorter length of the substrate connection portion 36B than the substrate connection portion 36A, the movable piece 31B of the lower terminal 30B is prolonged to ensure the spring length as long as practically possible. To be adapted for such a structure of the lower terminal 30B, as described above, the lower-terminal fixing groove 12*b* (see FIG. 9) for fixing the lower terminal 30B to the fixed housing 10 is formed to be deeper than the upper-terminal fixing groove 12*a* (see FIG. 8) in the depth direction.

The movable piece 31B includes a fixed-housing-side base portion 37B, a movable spring portion 38B, i.e., a "movable portion", and a movable-housing-side base portion 39B. The fixed-housing-side base portion 37B is formed in a shorter length than the fixed-housing-side base portion 37A such that a movable region of the movable spring portion 38B of the lower terminal 30B does not overlap a movable region of the movable spring portion 38A of the upper terminal 30A. Furthermore, press-fitting projections 37Ba projecting from the fixed-housing-side base portion 37B are press-fitted and engaged into the lower-terminal fixing groove 12*b* formed in the rear surface portion 11*a* of the fixed housing 10, whereby the lower terminal 30B is fixed to the fixed housing 10.

Figure 9:
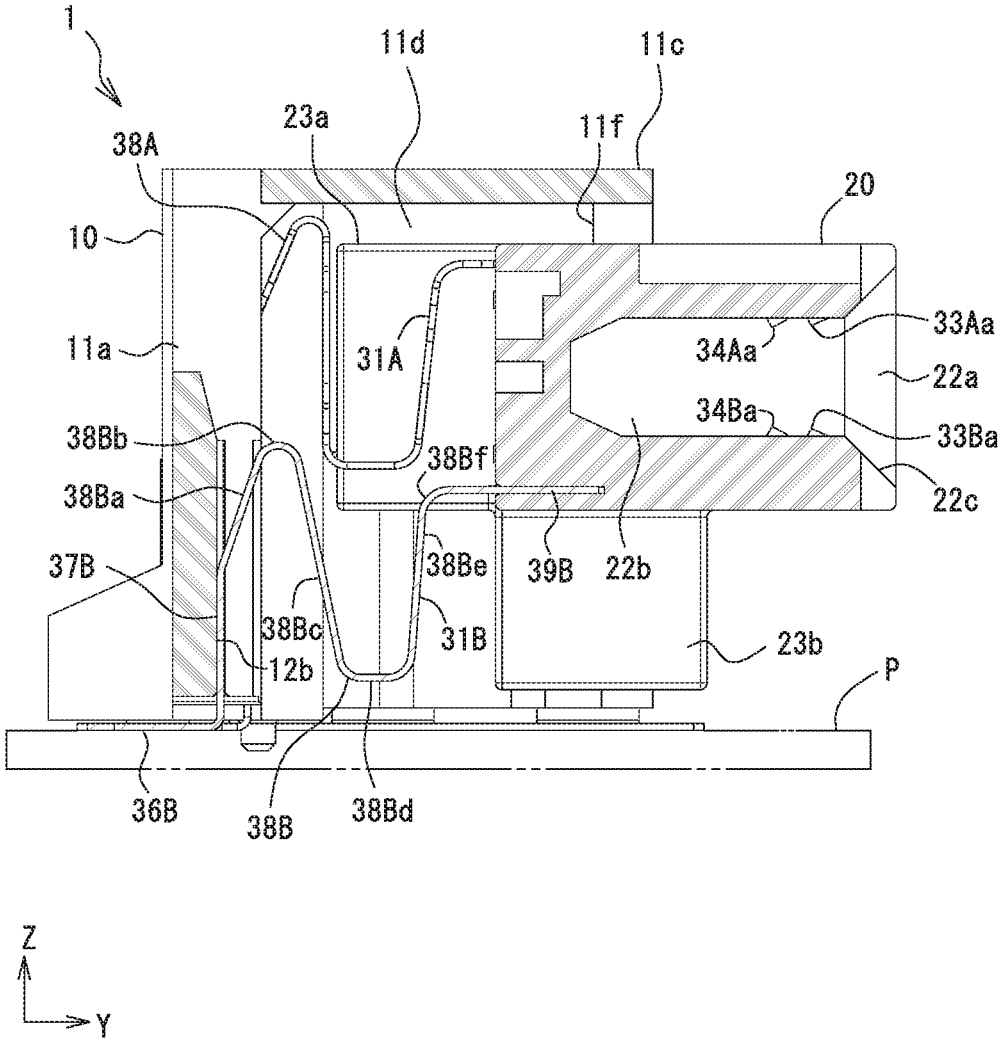
FIG. 9 is a sectional view taken along line IX-IX in FIG. 2.

As illustrated in FIGS. 5 and 9, the movable spring portion 38B includes a first vertical piece portion 38Ba, i.e., a "vertical piece portion", a first bent portion 38Bb, i.e., a "bent portion", a second vertical piece portion 38Bc, i.e., a "vertical piece portion", a second bent portion 38Bd, i.e., a "bent portion", a third vertical piece portion 38Be, i.e., a "vertical piece portion", and a third bent portion 38Bf, i.e., a "bent portion", in sequence from the side closer to the fixed-housing-side base portion 37B.

The movable spring portion 38B is constituted to be not contacted with the rear surface portion 11*a* and the movable spring portion 38A when deformed upon receiving loads generated with operations of inserting and withdrawing the plug connector.

To that end, the first vertical piece portion 38Ba extends while inclining forward relative to the up-down direction. Accordingly, a space allowing the first vertical piece portion 38Ba to be displaced rearward when the plug connector is inserted can be ensured, and the first bent portion 38Bb can be prevented from coming into contact with the rear surface portion 11*a*.

Furthermore, because the first vertical piece portion 38Ba extends at a gradient closer to the vertical direction than the first vertical piece portion 38Aa, the first bent portion 38Bb is positioned rearward of the second bent portion 38Ad in the front-rear direction (see FIGS. 6 to 9). Thus, the movable spring portion 38A and the movable spring portion 38B do not overlap with each other in side view.

Unlike the second vertical piece portion 38Ac, the second vertical piece portion 38Bc extends obliquely downward and forward in the front-rear direction. If the second vertical piece portion 38Bc extends in the vertical direction, there is a possibility that, when deformed upon receiving the load in the insertion direction of the plug connector, the first bent portion 38Bb may tilt forward in the front-rear direction with a joined point between the second vertical piece portion 38Bc and the second bent portion 38Bd being a fulcrum, thus there is possibility of contact with the second bent portion 38Ad. However, because the second vertical piece portion 38Bc extends obliquely downward and the joined point between the second vertical piece portion 38Bc and the second bent portion 38Bd is positioned forward of the first bent portion 38Bb, the first bent portion 38Bb is not deformed to such an extent as tilting forward in the front-rear direction and is prevented from coming into contact with the second bent portion 38Ad when deformed upon receiving the load in the insertion direction of the plug connector.

With the above-described configuration, the movable spring portion 38B can more easily absorb forces acting rearward and upward than the movable spring portion 38A, and can be prevented from coming into contact with the rear surface portion 11*a* and the movable spring portion 38A even if it is deformed to a large extent.

The thus-constituted lower terminal 30B including the substrate connection portion 36B, the fixed-housing-side base portion 37B, and the movable spring portion 38*b* is fixed to the movable housing 20 in such a manner that press-fitting projections 39Ba, i.e., "fixing portions", projecting from the movable-housing-side base portion 39B are press-fitted and engaged into the movable-piece-side receiving portion 24Ba.

An orientation of the contact piece 32B relative to the movable piece 31B is reversed between the upper terminal 30A and the lower terminal 30B. In the lower terminal 30B, the front elastic arm 33Bb and the rear elastic arm 34Bb act to bring the front contact point 33Ba and the rear contact point 34Ba into pressure contact with the terminal of the plug connector from the lower side toward the upper side in the up-down direction. Accordingly, the plate-thickness-direction conversion portion 35B is arranged in an orientation projecting downward.

Furthermore, parts of the front backside edge 33Bd and the front contact edge 33Be, as well as the front contact point 33Ba are projected upward into the fitting connection chamber 22*b* from the contact-piece-side receiving portion 24Bb in the bottom surface portion 21*d* of the movable housing 20, and are brought into pressure contact with the terminal of the plug connector (see FIGS. 6 to 9). Similarly, parts of the rear backside edge 34Bd and the rear contact edge 34Be, as well as the rear contact point 34Ba are projected upward into the fitting connection chamber 22*b* from the contact-piece-side receiving portion 24Bb in the bottom surface portion 21*d* of the movable housing 20, and are brought into pressure contact with the terminal of the plug connector (see FIGS. 6 to 9).

According to this embodiment, as described above, since the terminal 30 includes the plate-thickness-direction conversion portion 35, the influence of the plate thickness of the movable piece 31 can be avoided from spreading to the contact piece 32 in spite of the movable piece 31 and the contact piece 32 being in the integral form. In other words, the movable piece 31 being relatively thin can be formed by using, as a metal plate for the terminal 30, a material having a smaller plate thickness with intent to, for example, increase flexibility of the movable piece 31.

Furthermore, according to this embodiment, because of including the front elastic arm 33*b* and the rear elastic arm 34*b* that are elastically deformed in the direction crossing the plate thickness direction of the contact piece 32 when the plug connector is inserted into the movable connector 1, the contact pressures at the front contact point 33*a* and the rear contact point 34*a* against the terminal of the plug connector are less apt to lower even with the plate thickness of the terminal 30 being reduced. In short, the movable connector 1 can be provided in which vibration is more easily absorbed and stress is distributed in the movable piece 31, thus realizing improved durability, while slight sliding is less apt to occur in the contact piece 32 between each of the front contact point 33*a* and the rear contact point 34*a* and the terminal of the plug connector.

What is claimed is:

1. A movable connector comprising:

a first housing;

a second housing into which a connection target is to be fitted; and a terminal including a movable piece that supports the second housing in a displaceable way relative to the first housing, and a contact piece having a contact point that is brought into contact with the connection target for conductive connection, wherein the terminal includes:

a plate-thickness-direction conversion portion that interconnects the movable piece and the contact piece, and that reverses a plate thickness direction and a plate width direction of the terminal between the movable piece and the contact piece; and an elastic arm that is configured to elastically deform in a direction crossing the plate thickness direction, and configured to press the contact point against the connection object, and wherein the movable piece is formed so as to be bent in a direction crossing the plate width direction.

2. The movable connector according to claim 1, wherein the contact piece includes a contact-piece base portion joined to the plate-thickness-direction conversion portion, the second housing includes a terminal receiving portion that has a bent groove-like shape, and that receives the plate-thickness-direction conversion portion and the contact-piece base portion, and the contact-piece base portion includes a press-fitting projection that is projected from a plate surface of the contact-piece base portion in the plate thickness direction, and that is press-fitted and fixed to the terminal receiving portion.

3. The movable connector according to claim 2, wherein the press-fitting projection has a shape projecting from the plate surface of the contact-piece base portion in the plate thickness direction on internal angle side relative to the contact-piece base portion and the plate-thickness-direction conversion portion.

4. The movable connector according to claim 1, wherein the movable piece includes:

a movable portion; and a second-housing-side base portion, wherein the second-housing-side base portion is arranged between the plate-thickness-direction conversion portion and the movable portion, and includes a fixing portion for fixing the movable piece to the second housing.

5. The movable connector according to claim 1, wherein the second housing includes a fitting connection chamber into which the connection target is inserted along a plane direction of a mounting surface of a substrate to which the first housing is mounted, and the movable piece has a vertically-vibrating wave shape including:

a plurality of vertical piece portions each extending in a direction crossing an insertion direction of the connection target into the fitting connection chamber; and a bent portion interconnecting ends of the vertical piece portions adjacent to each other.

6. A terminal comprising:

a movable piece for supporting a housing in a displaceable way relative to another housing;

a contact piece having a contact point for bringing into contact with a connection target for conductive connection;

a plate-thickness-direction conversion portion that interconnects the movable piece and the contact piece, and that reverses a plate thickness direction and a plate width direction of the terminal between the movable piece and the contact piece; and an elastic arm that is configured to elastically deform in a direction crossing the plate thickness direction, and configured to press the contact point against the connection object, and wherein the movable piece is formed so as to be bent in a direction crossing the plate width direction.

* * * * *